United States Patent [19]

Butman et al.

[11] 3,969,712

[45] July 13, 1976

[54] POOL ALARM

[75] Inventors: Jerry Butman, Palos Verdes Peninsula; Thomas L. Grettenberg, Marina Del Rey, both of Calif.

[73] Assignee: Applied Systems Laboratories, Palos Verdes Peninsula, Calif.

[22] Filed: May 25, 1973

[21] Appl. No.: 364,098

[52] U.S. Cl. ..... 340/261; 340/258 D

[51] Int. Cl.[2] ..... G08B 13/16

[58] Field of Search ..... 340/261

[56] References Cited

UNITED STATES PATENTS

| | | | |
|---|---|---|---|
| 2,832,915 | 4/1958 | McCoy | 340/261 X |
| 2,942,247 | 6/1960 | Lienau et al. | 340/261 X |
| 3,475,746 | 10/1969 | Nelson et al. | 340/261 |

*Primary Examiner*—David L. Trafton

*Attorney, Agent, or Firm*—Lindenberg, Freilich, Wasserman, Rosen & Fernandez

[57] ABSTRACT

A device designed to float in a home pool and sound an alarm when the water is disturbed, which is peculiarly sensitive to disturbances in the water, including a transducer for sensing noise in the water, a high frequency filter connected to the transducer, a saturable amplifier connected to the filter, an integrator connected to the amplifier, and a trigger circuit connected to the integrator for initiating an alarm. The integrator has a rise time on the order of fifty milliseconds so that it rejects moderately loud disturbances unless they repeat many times within a short period of time, as is the case in noise reflected off the walls of an average size pool. The decay time of the integrator exceeds five hundred milliseconds so that the integrator output builds up over the period of at least two or three major noise pulses of a typical moderate splash in water.

2 Claims, 9 Drawing Figures

AMPLITUDE OF HF NOISE AT SOURCE

HF NOISE AT TRANSDUCER

INTEGRATOR OUTPUT
TRIGGER LEVEL

POOL ALARM

BACKGROUND OF THE INVENTION

This invention relates to alarm devices designed for use in swimming pools and similar small bodies of water.

One type of swimming pool alarm includes a transducer for picking up sounds from the water and a bell or alarm that is triggered when sounds in the water exceed a predetermined level. Such devices generally do not work well in normal use because they are either too sensitive or not sensitive enough. Moderately sensitive pool alarms may be set off by loud noises, such as nearby traffic or clapping of the hands, or by electromagnetic waves generated by nearby power lines. If the sensitivity is reduced to prevent false alarms, then the device may not be triggered by a moderately loud splash such as if a child falls into the pool at an end thereof opposite the transducer. Actually, many pool accidents could be avoided if the alarm would sound when a child merely waves his hands in the water near the side of the pool. Previous pool alarms could not detect such a slight disturbance without being so sensitive as to be repeatedly set off by ambient non-pool noises.

SUMMARY OF THE INVENTION

In accordance with one embodiment of the present invention, a pool alarm is provided for use in a typical home pool, which sounds an alarm when even small splashes are made in the pool, but which is not triggered by even relatively loud noises outside the pool or large elctrical disturbances. The pool alarm includes a housing that is buoyant in water, a transducer mounted on the housing to contact the water, an alarm bell on top of the housing for sounding an alarm, and a circuit connected between the transducer and alarm to determine when the alarm will be sounded. The circuit includes a high frequency filter for passing noise components most typical of splashes in water, a saturable amplifier for amplifying the high frequency noise components, a detector integrator for summing the amplitude of the high frequency components, and a trigger circuit for sounding the alarm when the integrator output exceeds a predetermined triggering level. The parameters in the design of the circuit are based on the unique characteristics of splashes in water and the fact that most pools are of the same order of size so that most of the high energy noise reflections off the walls of the pool occur within a certain time period. The rise time of the integrator is on the order of 50 milliseconds, which is long enough for the transducer to pick up most of the energetic reflections of noise off the pool walls for a pool of typical size. The decay time of the integrator is more than 500 milliseconds, so that it sums several typical bursts of energy spaced perhaps 200 milliseconds apart which occur in typical water splashes.

The novel features that are considered characteristic of this invention are set forth with particularly in the appended claims. The invention will best be understood from the following description when read in connection with the accompanying drawings.

DESCRIPTION OF THE PREFERRED EMBODIMENT

Figure 1:
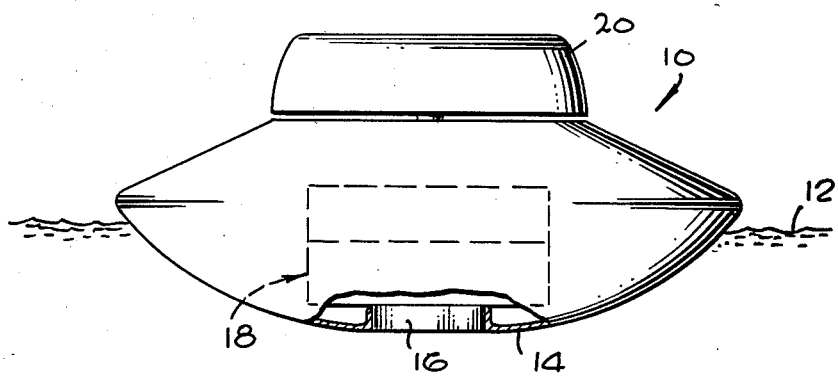
FIG. 1 is a side elevation view of a pool alarm constructed in accordance with the invention, showing it floating in water.

FIG. 1 illustrates a pool alarm device 10 constructed in accordance with the invention, showing it in use wherein it floats on the surface 12 of a body of water. The device includes a housing 14 of electrically conductive material, such as aluminum, which contains a transducer 16 that contacts the water. The housing also contains a circuit 18 that processes signals from the transducer, to sound an alarm or bell 20 that is mounted on top of the housing. The pool alarm 10 is especially useful in the manner illustrated in FIG. 2, wherein it floats on the water 12 in a typical home pool 22. When a splash occurs as indicated by the arrow 24, noises are generated which are sensed by the transducer of the pool alarm. When the device senses a splash, it rings the bell 20. The device 10 can be used to guard a pool during the times when persons, and particularly children, are not authorized to be in the pool or in the immediately surrounding area. When the alarm sounds, any adults in the area are warned to check the pool, and even if no adults are nearby, any children playing near the pool will be frightened away.

The pool alarm 10 is designed to be set off by even small splashes such as those created by a child kneeling beside the edge of the pool and waving his hand in the water. Such a child will be frightened away before he has a chance to enter the pool intentionally or accidentally. In order to achieve high sensitivity to splashing noises anywhere on the pool surface, and yet to provide insensitivity to loud external noises or electrical disturbances, use is made of the characteristics of splashing sounds made in a typical home pool. One characteristic of splashing sounds is that they have a considerable high frequency component at a frequency such as 15 KHz. A wide range of other sounds such as from nearby vehicle traffic and shouting may be loud but generally do not have a large high frequency component above about 5 kilohertz. Another characteristic that is made use of is the fact that splashes in water typically include primarily bursts of sound energy, each of a duration on the order of 20 milliseconds, and with such bursts spaced apart on the order of 200 milliseconds. The first three to five of such bursts are typically the most energetic, and most of the sound energy is produced by those splashes.

Figure 2:
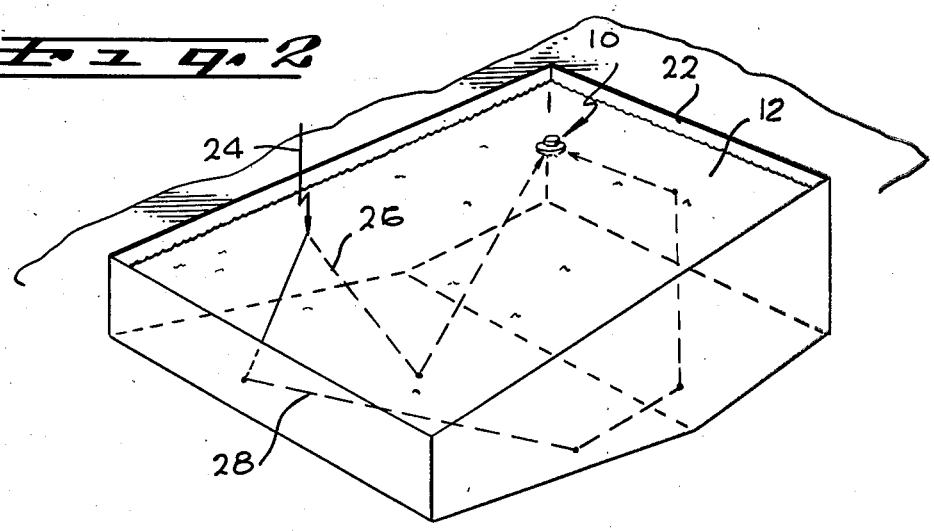
FIG. 2 is a diagrammatic view showing typical paths of sound wave between a splash point and the pool alarm of FIG. 1 when the pool alarm is floating in a typical home pool.

Still another factor that is made use of in making the pool alarm device sensitive primarily to splashes is the fact that most home pools are of the same order of size, such as on the order of 25 feet in each horizontal dimension and on the order of ten feet maximum depth. A sound wave travels at approximately 5,000 feet per second in water and reflects off the surfaces of the pool and off the water-air interface with little attenuation, and considerable energy remains in each sound wave up to a travel of 250 feet wherein it may have undergone 20 reflections. Such travel of approximately 250 feet is accomplished in approximately 50 milliseconds, and after that time the amount of remaining energy in the sound wave is relatively small. FIG. 2 illustrates two sound waves 26, 28 that emanate from the splash and are received by the transducer of the pool alarm device 10, one of the waves 26 undergoing only one reflection and the other 28 undergoing four reflections. Many energetic waves undergo many more reflections before reaching the transducer of the pool alarm device.

Figure 3:
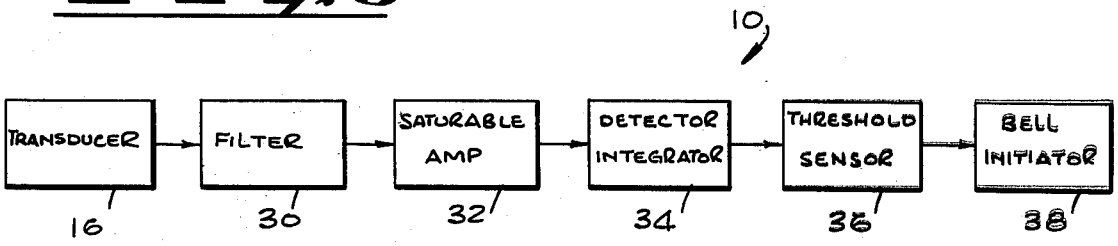
FIG. 3 is a block diagram of the pool alarm of FIG. 1.

FIG. 3 is a block diagram showing the basic circuit elements of the pool alarm device 10. Signals picked up by the transducer 16 are passed through a filtr 30 which passes only certain high frequency components, such as between 10 and 20 kilocycles; that is, the filter 30 may have a center pass frequency of 15 kilocycles. and a 3 db rolloff at ten and 20 kilocycles. The high frequency band pass filter 30 therefore eliminates signals from loud noises that do not include large high frequency components that are present in water splashes. The transducer 16 can itself serve as a filter if it is sensitive to only certain frequencies, so the transducer and filter 30 may be considered as a combined transducer-filter means.

The high frequency components from the filter 30 enter a saturable amplifier 32 which amplifies them and delivers them to a detector integrator 34. The integrator 34 has a predetermined rise time such as 50 milliseconds, that is, a constant input to the integrator will result in an output level of 63% of the final or eventual output after 50 milliseconds. A rise time on the order of fifth milliseconds is chosen to correspond to the fact that multiple reverberations in a typical home pool will provide a considerable sound at the transducer during a period period of about 50 milliseconds, and that a few of such periods (spaced about 200 milliseconds apart) will occur. The integrator 34 has a decay time which is preferably more than 500 milliseconds, so that at least a few bursts of sound energy from a typical splash (spaced about 200 milliseconds apart) will be added in the integrator to contribute to its output. Actually, a much longer decay time, such as several seconds, can be employed to increase sensitivity to splash sound without appreciably increasing sensitivity to other types of disturbances that typically occur. The output of the integrator 34 is sensed by a threshold sensor 36 which serves as a trigger to activate a bell initiator 38 that latches on to ring the bell 20.

The saturable amplifier 32 which amplifies the sound signals prior to their delivery to the integrator 34, is provided to prevent initiation by brief but very loud disturbances. Such a disturbance will cause the amplifier 32 to produce a few pulses, but not enough to charge the integrator 34 to the triggering level. On the other hand, even moderately small splashes will produce signals strong enough at the transducer to drive the amplifier 32 to saturation, so that pulses are transmitted to the integrator 32 to begin charging it. Unlike loud but short outside disturbances, splashes produce sounds for extended periods, such as 50 milliseconds, due to reverberations within the pool. Accordingly, enough pulses will enter the integrator 34 to appreciably charge it. Also, several of such sound bursts will be produced so that the integrator can be readily charged to the triggering point at which the bell is sounded.

Figures 4, 5, 6, 9:
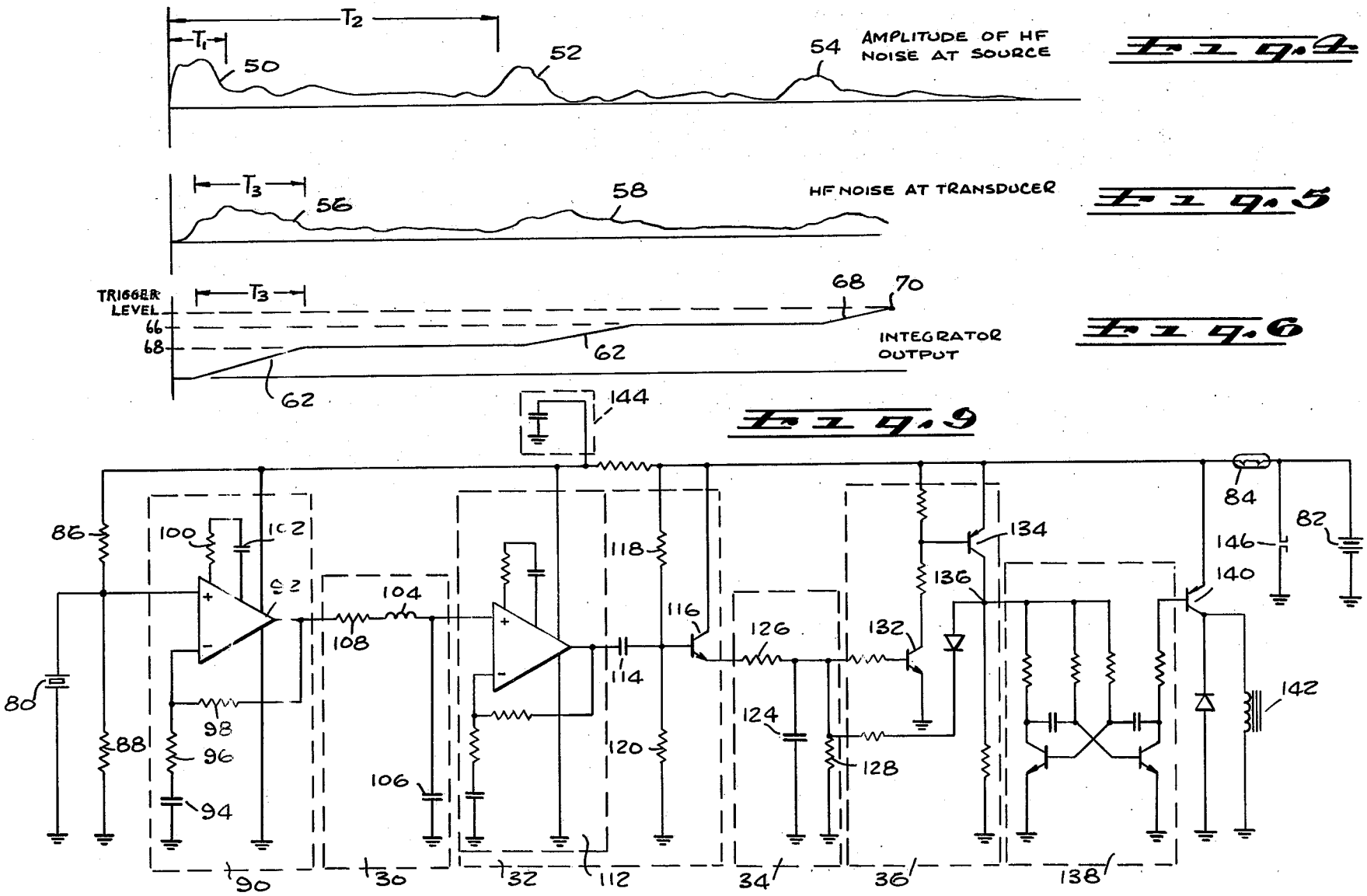
FIG. 4 is a simplified illustration of the amplitude of the high frequency components of noise generated at a splash location.
FIG. 5 is a simplified illustration of the noise component of FIG. 4 as it appears at the pool alarm located in a different region of the same pool in which the splash occurs.
FIG. 6 illustrates the gross charging characteristics of the integrator of the circuit of the pool alarm.
FIG. 9 is a schematic diagram of the circuit of the pool alarm of FIG. 1.

FIG. 4 is a simplified illustration of the high frequency components of noise produced at the location of a splash in water. A first burst 50 lasts for a short time $T_1$ such as 20 milliseconds, and a next energetic burst 52 begins after a period $T_2$ such as 200 milliseconds after the first burst began. A third burst 54 occurs about 200 milliseconds after the second one, and so forth, so that a total of perhaps five or 10 energetic bursts of sound may be generated. It should be noted that the graph of FIG. 4 does not represent all of the sound generated at the splash location, but only a high frequency component such as between the frequencies of 10 and 20 kilohertz, because these frequencies are present in considerable magnitudes in splashes but not in most other extended disturbances present nar swimming pools.

FIG. 5 is a simplified illustration of the high frequency components which reach the transducer 16 of the pool alarm device when it is located in a typical home pool. A first burst 56 lasting for a period of $T_3$ on the order of 50 milliseconds is present due to reverberations within the pool. As described above, a sound wave of high energy will produce energetic components at the transducer, even for components that have made perhaps twenty reflections off the pool walls and water-air interface and that have traveled perhaps 250 feet, all of which occurs during a period of about 50 milliseconds. A next burst 58 at the transducer will begin about 200 milliseconds after the first burst began, and will also last on the order of 50 milliseconds, and several subsequent bursts will similarly occur.

FIG. 6 is a simplified illustration of the integrator output resulting from the sound of FIG. 5 reaching the transducer. During the period of the first energetic burst of high frequency sound that lasts for the period $T_3$, the integrator output will increase along the curve portion 60 to a first level 62. During the next period of perhaps 150 milliseconds, when only a low level of sound is received at the transducer, the sound is not intense enough to drive the saturable amplifier to saturation. The amplifier then produces very little output, so that the integrator output remains almost constant. However, when the next burst of sound (58 in FIG. 5) is received at the transducer, the saturable amplifier is again driven to saturation and signals from it enter the integrator over another curve portion 62 that raises the integrator up to a next level 66. After another period of perhaps 150 milliseconds, another burst of energetic sound is received and the integrator output rises along the curve portion 68 to the trigger level at point 70 at which the threshold sensor 36 (FIG. 3) is triggered to begin ringing the bell. Thus, very intense but brief high frequency sounds, such as may be included in a loud clap of the hands, do not last long enough to raise the integrator output to the triggering level, and yet a moderate intensity sound that lasts for a long enough time, as is characteristic of splash sounds reverberating in a pool, raises the integrator to a triggering level.

Figure 7:
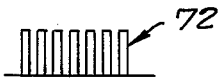
FIG. 7 is a simplified detailed view of charging currents applied to the integrator of the pool alarm.
Figure 8:
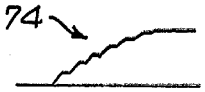
FIG. 8 is a simplified detailed view of the integrator output resulting from the signals of FIG. 7 applied to the integrator.

The actual signal which is delivered by the saturable amplifier to the charging portion of the integrator includes a series of short duration pulses occurring at a rate such as 15 kilohertz, as indicated in FIG. 7 at 72. These pulses cause the integrator output to rise in small steps as indicated in FIG. 8 at 74. Actually, a large number, such as 1,000, of such pulses may be received in a period such as 50 milliseconds, after which no further pulses may be received for a period such as 150 milliseconds during which time the integrator output does not appreciably change. It may be noted that the decay of the integrator output between the bursts of energy is relatively small where the decay time constant is fairly large, such as one second, and the decay is only moderate even for a short decay time such as 500 milliseconds.

FIG. 9 is a schematic diagram of a pool alarm which has been constructed and found to provide high sensitivity to water splashes and low sensitivity to extraneous noise commonly found near home pools. The circuit includes a piezoelectric transducer 80, such as a lead-zirconate-titanate ceramic, which is sensitive to frequencies on the order of 15 kilohertz. A voltage is supplied by a battery 82 through a tilt switch 84 to a voltage divider which includes resistors 86, 88, to the transducer. The output of the transducer is applied to an amplifier stage 90 which includes an operational amplifier 92, a feedback circuit including components 94, 96 and 98 that control the amplifier gain, and a compensation network formed by components 100, 102 that prevent oscillation. The output of the amplifier 90 is passed through the filter 30, which includes an inductor 104 of 0.87 millihenries and a capacitor 106 of 0.1 microfarads that form a band pass filter with a center frequency of approximately 15 kilohertz. A resistance 108 of 22 ohms determines the Q or pass band of the filter, which is approximately 13.5 kilohertz to 16.5 kilohertz. The output of the filter 30 enters a saturable amplifier 32 with a portion 112 similar to the amplifier 90 and which can be made identical thereto. The output of this amplifier portion 112 passes through a small coupling capacitor 114 to drive a detector transistor 116 that is biased by a pair of resistors 118, 120 in order to enhance detector sensitivity.

The output of the saturable amplifier 32 enters the integrating circuit 34 which includes a capacitor 124 of ten microfarads, a charging resistor 126 of 4.7 kilohms, and a discharging resistor 128 of 100 kilohms. The combination of the resistor 126 and capacitor 124 acts as a charging circuit with a time constant of 47 milliseconds. The combination of the capacitor 124 and resistor 128 acts as a discharging circuit with a time constant of 1 second. While a charging time constant of about 47 of 50 milliseconds has been found to work well, time constants between about twenty and seventy milliseconds have also been found to work well.

The output of the integrator, which is the voltage across the capacitor 124, is sensed by a threshold and triggering circuit or sensor 36. When a certain threshold voltage, such as 0.7 volts, is reached at the capacitor 124 of the integrator, a transistor 132 turns on and causes a second transistor 134 to turn on so that the voltage at point 136 rises. The output at point 136 is connected to a multivibrator 138 to start it and cause it to repeatedly turn on and off a power transistor 140 at a frequency such as ten hertz. The power transistor 140 therefore repeatedly energizes a solenoid 142 that moves a striker to hit the bell 20 on the pool alarm device.

The circuit of FIG. 9 is provided with several additional portions that aid its efficient and convenient operation. An RC filter 144 is provided to filter output signals feeding back to the input via the battery 82. A jack 146 is provided to enable recharging of the batteries 82 where rechargeable batteries are utilized. The switch 84 is provided to enable a person to prevent sounding of the alarm when he is carrying the pool alarm device to the pool and to facilitate turning off the device after it has begun sounding. The switch 84 is a mercury-type and is oriented so that it is not turned on unless the device is within about 30° from a horizontal position. Thus, the pool alarm device can be stored and handled without setting off the alarm, by always keeping the housing turned at least about 30° from the horizontal. In a pool alarm device of the type described above that was constructed, it was found that the circuit would be triggered by moderately loud sounds when the transducer was out of the water (and the housing was horizontal). When the device is in the water, sounds in the air cannot readily enter the transducer, because the transducer portion directly accessible through the housing faces the water and sounds in the air cannot readily enter the water.

Thus, the invention provides a pool alarm which is highly sensitive to splashes in the water, particularly for splashes in a typical home pool, and which is insensitive to disturbances other than such splashes. The alarm is therefore readily set off by children playing at the edge of the pool even before they have a chance to jump or fall in, and yet the device rarely gives a false alarm. Such selective sensitivity is produced by utilizing an integrator with a rise time on the order of 50 milliseconds and with a decay time exceeding 500 milliseconds, which may have a value such as one second, so that the integrator is peculiarly sensitive to splash-type noises. The integrator is charged through a saturable amplifier, so that even very intense disturbances do not trigger the alarm if they do not last long, and yet even relatively small splashes will trigger the alarm. A relatively high frequency band pass filter is also employed between he transducer and integrator to make the device more peculiarly sensitive to splash-type noises that have such high frequency components. The device is designed to be floated in a pool so that it normally does not make firm contact with a solid surface that could transmit ground noises to the transducer. The circuitry is surrounded by an electrically conductive housing to minimize the pickup of electromagnetic radiation such as arcing in nearby motors or energy from power lines. A magnetic shield, such as a steel case, may also be utilized about the circuits. The transducer faces downwardly into the water and therefore is most sensitive to vibrations in the water. The device includes a tilt switch that prevents activation until the housing is floated on the water, so that the device is easily activated and deactivated and can be readily stored and carried without the need for a manually operated switch that a user may forget to turn on.

Although particular embodiments of the invention have been described and illustrated herein, it is recognized that modifications and variations may readily occur to those skilled in the art and consequently it is intended that the claims be interpreted to cover such moficiations and equivalents.

What is claimed is:

1. Pool alarm apparatus comprising:

transducer and filter means including a transducer, said means being responsive to noise in water for generating electrical signals representing primarily predetermined frequency components of the noise;

integrator means coupled to said transducer and filter means for generating a signal which increases in amplitude when signals are received from the filter means over an extended period of time;

threshold responsive means coupled to said integrator means for initiating an alarm when the integrator output reaches a predetermined level;

a watertight housing containing said integrator means and threshold responsive means, said housing being buoyant in water and floating in a predetermined orientation, and said housing having a downwardly facing aperture containing said transducer; and a tilt sensitive switch on said housing, which prevents alarm initiation unless the housing is substantially level.

2. Pool alarm apparatus comprising:

transducer and filter means responsive to noise in water for generating electrical signals representing primarily predetermined frequency components of the noise of a frequency of a plurality of kilohertz;

saturable amplifier means coupled to said filter means, for limiting the amplitude of signals from said filter means;

integrator means coupled to said saturable amplifier means for generating a signsl which increases in amplitude when signals are received from the saturable amplifier means over an extended period of time; and threshold responsive means coupled to said integrator means for initiating an alarm when the integrator output reaches a predetermined level;

the rise time constant of said integrator means, required for the output to reach 63% of the eventual output level during the application of a constant input, being on the order of 50 milliseconds, whereby to normally prevent triggering by a short loud noise pulse and yet to permit triggering by a splash noise reverberating through a typical water-filled home pool.

* * * * *